US009907348B2

(12) United States Patent
Huh

(10) Patent No.: US 9,907,348 B2
(45) Date of Patent: Mar. 6, 2018

(54) FUNCTIONAL HEADBAND HAVING INTEGRAL CUSHION BAND

(71) Applicant: OTOS WING CO., LTD., Seoul (KR)

(72) Inventor: Sung Won Huh, Seoul (KR)

(73) Assignee: OTOS WING CO., LTD., Seoul (KR)

( * ) Notice: Subject to any disclaimer, the term of this patent is extended or adjusted under 35 U.S.C. 154(b) by 210 days.

(21) Appl. No.: 14/877,202

(22) Filed: Oct. 7, 2015

(65) Prior Publication Data

US 2016/0262484 A1 Sep. 15, 2016

(30) Foreign Application Priority Data

Mar. 13, 2015 (KR) ..... 10-2015-0034760

(51) Int. Cl.
*A42B 3/00* (2006.01)
*A42B 3/14* (2006.01)

(52) U.S. Cl.
CPC ..... *A42B 3/14* (2013.01); *A42B 3/142* (2013.01); *A42B 3/145* (2013.01); *A42B 3/147* (2013.01)

(58) Field of Classification Search
CPC ..... A42B 3/145; A42B 3/14; A42B 3/142; A42B 3/147
USPC ..... D29/122
See application file for complete search history.

(56) References Cited

U.S. PATENT DOCUMENTS

2010/0229274 A1* 9/2010 Ahlgren ..... A42B 3/225 2/8.2
2010/0229286 A1* 9/2010 Ahlgren ..... A42B 3/142 2/416
2012/0144565 A1* 6/2012 Huh ..... A42B 3/145 2/421
2013/0111653 A1* 5/2013 Huh ..... A42B 3/14 2/421
2015/0026871 A1* 1/2015 Gotti ..... A42B 3/0406 2/418
2015/0143669 A1* 5/2015 Pereira ..... A42B 1/24 24/3.12

* cited by examiner

*Primary Examiner* — Khaled Annis
(74) *Attorney, Agent, or Firm* — Cantor Colburn LLP

(57) ABSTRACT

Provided is a functional headband having an integral cushion band that is applied to welding masks, protective masks, safety helmets, medical helmets, etc. The functional headband includes a main band configured to be worn on a wearer's head, supporting bands connected with the main band and configured to be placed on the wearer's head, adjustment bands connected with both ends of the main band and configured to be adjusted in length, a length adjustment lever configured to adjust the length of the adjustment bands, and cushion bands formed integrally at the supporting bands to cover the wearer's head, thereby supporting the wearer's head in a double supporting structure.

9 Claims, 11 Drawing Sheets

FUNCTIONAL HEADBAND HAVING INTEGRAL CUSHION BAND

BACKGROUND OF THE INVENTION

Field of the Invention

The present invention relates to a functional headband that is applied to welding masks, protective masks, safety helmets, medical helmets, etc. and, more particularly, to a functional headband having an integral cushion band which is formed at supporting bands, thereby supporting a wearer's head in a double supporting structure.

Description of the Related Art

In general, industrial safety equipment, such as welding masks, protective masks, safety helmets, etc., and medical safety equipment, such as medical head guards, medical safety helmets, etc., are commonly used in various industrial (e.g. construction or civil engineering) and medical sites, in order to protect a worker or a wearer from any accident while working.

In one example, a welding operation generates a strong flash of light and causes welding material to be scattered toward the welder's face. A welding mask has been used as a representative example of safety equipment to protect the welder's eyes and face from the aforementioned dangers.

A welding mask generally includes a protective mask configured to cover a welder's face along with a viewing window to protect the welder's eyes and face, and a headband provided inside the protective mask to help the welder stably wear the protective mask on the head.

Such a headband includes a main band configured to surround the circumference of the wearer's head in the state of closely contacting the forehead, and a first supporting band and a second supporting band configured to surround the front section and the rear section of the head. The headband further includes a length adjustment lever, which is positioned on the rear section of the wearer's head and is connected with the main band through adjustment bands. That is, the adjustment bands are directly connected with the ends of the main band, and are coupled to the length adjustment lever.

A cushion member is attached to an inner surface of the length adjustment lever. The cushion member is centrally concave from upper and lower and left and right sides thereof so as to come into close contact with the rear section of the head. Such a cushion member comfortably surrounds the rear section of the wearer's head, thereby providing comfort and convenience in wearing a welding mask.

However, because the first supporting band and the second supporting band are in direct contact with the specific regions of the wearer's head, the wearing sensation is deteriorated. Further, when the wearer wears the headband for a long time, he or she feels uncomfortable and even develops a headache because of the pressure that is continuously applied to the specific regions of the head by the first supporting band and the second supporting band.

To solve this problem, the wearer temporarily puts an intervening member, constituted of a sheet of paper, cloth, etc., between the head and the first and second supporting bands so as to prevent the first and second supporting bands from intensively pressing the specific regions of the head.

However, the intervening member, constituted of a sheet of paper, cloth, etc., is often separated without being fixed between the head and the first and second supporting bands. Therefore, it is inconvenient for the wearer to put the intervening member back between the head and the first and second supporting bands while working, which obstructs work and deteriorates work efficiency.

Further, whenever the wearer takes off the headband, for example for a rest, and puts the headband back on to resume a work, he or she is inconvenienced by having to remove and remount the intervening member. Furthermore, the intervening member, made of a sheet of paper or cloth, may be easily lost if the wearer is careless.

SUMMARY OF THE INVENTION

The present invention is devised to solve the above problems, and it is an object of the present invention to provide a functional headband having an integral cushion band which is formed at supporting bands to assist in supporting the wearer's head, thereby facilitating mounting/demounting and replacement of the headband to/from industrial safety equipment, such as welding masks, protective masks, safety helmets, etc., and medical safety equipment, such as medical head guards, medical safety helmets, etc., easily supporting the whole region of the head, minimizing the pressure and acting as a buffer by dispersing the weight and load of the aforementioned safety equipment, and enabling the headband to be easily fitted on the wearer's head and to be securely maintained in close contact with the head regardless of the shape and size of the wearer's head.

In accordance with an aspect of the present invention, the above and other objects can be accomplished by the provision of a functional headband having an integral cushion band, the functional headband including a main band configured to be worn on a wearer's head, supporting bands connected with the main band and configured to be placed on the wearer's head, adjustment bands connected with both ends of the main band and configured to be adjusted in length, a length adjustment lever configured to adjust the length of the adjustment bands, and cushion bands formed integrally at the supporting bands to cover the wearer's head, thereby supporting the wearer's head in a double supporting structure.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
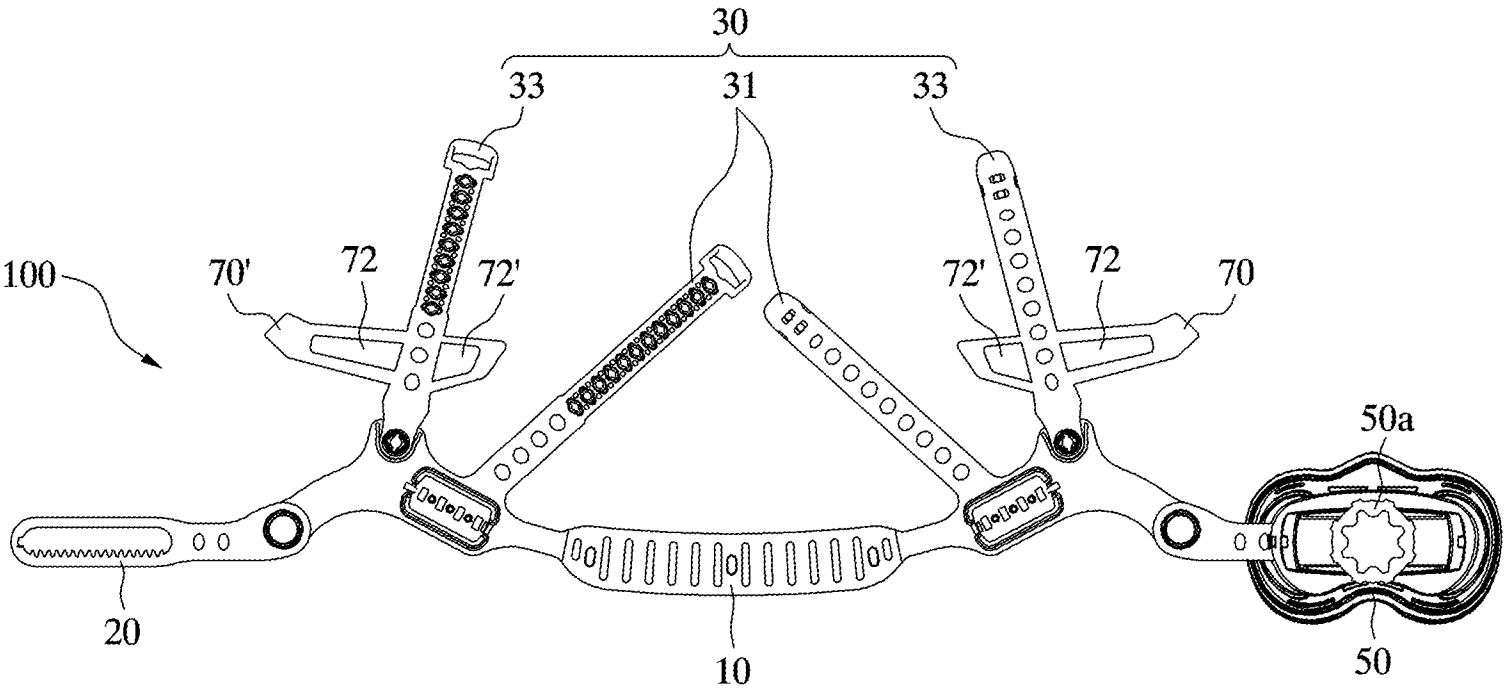
FIG. 1 is a development view illustrating a headband according to a first embodiment of the present invention.
Figure 2:
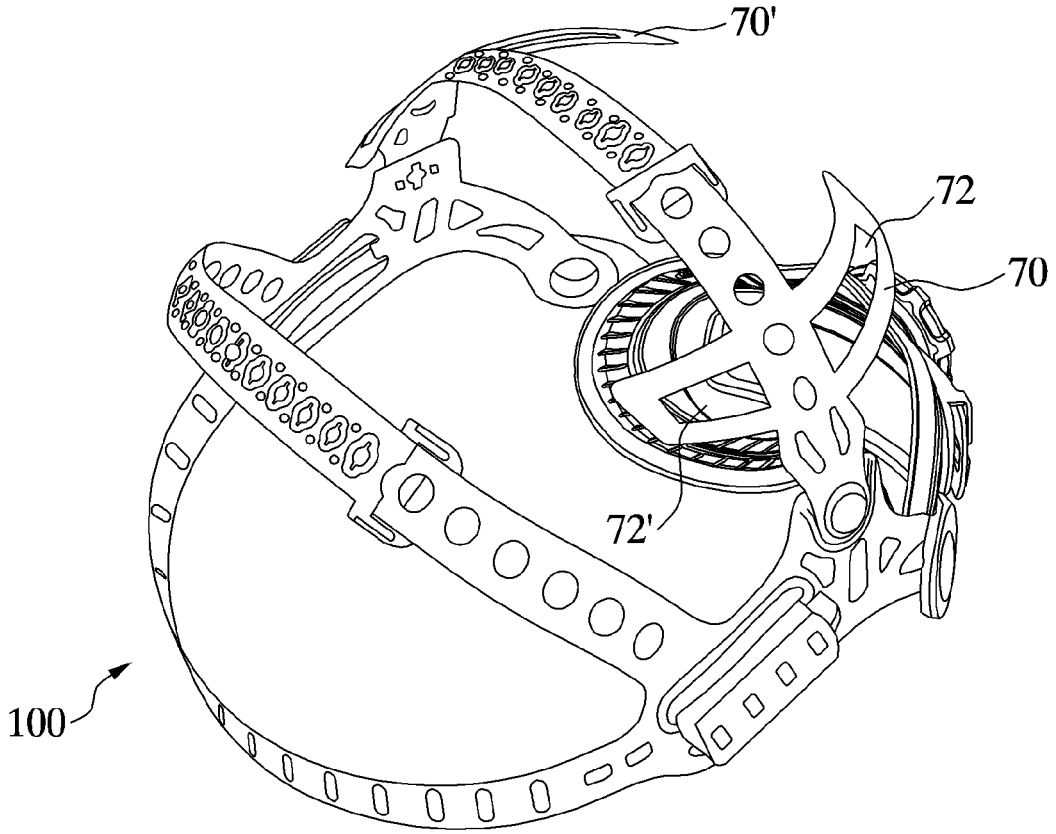
FIG. 2 is a perspective view illustrating the headband according to the first embodiment of the present invention.
Figure 3:
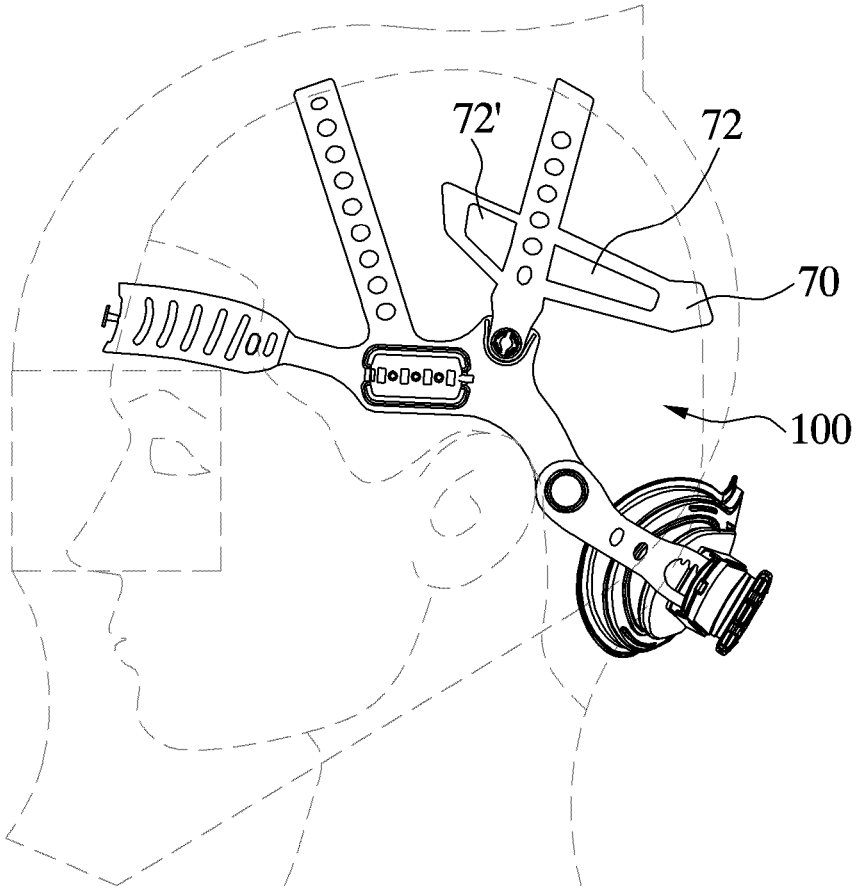
FIG. 3 is a perspective view illustrating the state in which the headband depicted in FIG. 2 is worn on a wearer's head.
Figure 4:
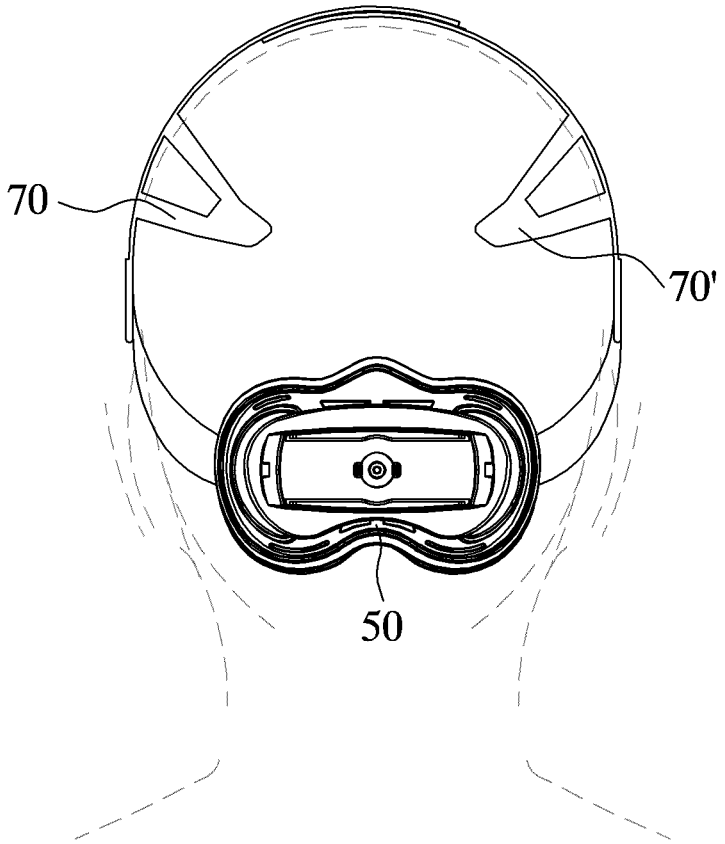
FIG. 4 is a rear view illustrating the state in which the headband depicted in FIG. 2 is worn on a wearer's head.

Hereinafter, preferred embodiments of the present invention will be described in detail with reference to the attached drawings.

Before explaining embodiments of the present invention, it is to be understood that the phraseology and terminology used in the following specification and appended claims should not be construed as limited to general and dictionary meanings but be construed as the meanings and concepts according to the spirit of the present invention on the basis of the principle that the inventor is permitted to define appropriate terms for the best explanation.

The preferred embodiments described in the following specification and shown in the accompanying drawings are illustrative only and are not intended to represent all aspects of the invention, so that it is to be understood that various equivalents and modifications can be made without departing from the spirit of the invention.

A functional headband 100 according to the present invention includes a main band 10 configured to be worn on a wearer's head, supporting bands 31 and 33 connected with the main band 10 and configured to be placed on the wearer's head, adjustment bands 20 connected with both ends of the main band 10 and configured to be adjusted in length, and a length adjustment lever 50 configured to adjust the length of the adjustment bands 20. The functional headband 100 further includes cushion bands 70 and 70', which are integrally formed at the supporting bands, thereby creating a double supporting structure capable of covering the wearer's head more stably.

The supporting bands include a first supporting band 31 and a second supporting band 33, and each of the first supporting band 31 and the second supporting band 33 is divided into two parts.

The cushion bands 70 and 70' may be formed at the two parts of the first supporting band 31, or may be formed at the two parts of the second supporting band 33, or may be formed at the two parts of each of the first supporting band 31 and the second supporting band 33.

The cushion bands 70 and 70' may be formed to have a wing shape that extends from one side of each of the supporting bands, or may be formed to have a wing shape that extends from both sides of each of the supporting bands. The functional headband having the above-described cushion bands has the effect of making a wearer feel as though the head were held in the hands, thereby providing a comfortable headband-wearing sensation.

The cushion band formed at the first supporting band 31 and the cushion band formed at the second supporting band 33 may be connected to each other.

The cushion bands 70 and 70' formed at the two parts of the second supporting band 33 may be connected to each other.

Each of the cushion bands 70 and 70' may be formed with one or more openings 72.

The contact surface of each of the cushion bands 70 and 70', which comes into contact with the head, may be made of an elastic material or a soft material through a double injection molding process. The cushion bands 70 and 70' may be bent at an angle ranging from 5 degrees to 60 degrees so as to be first placed on the head.

As shown in FIGS. 1 through 10, the cushion bands 70 and 70' according to the present invention are provided at the headband 100, which is applied to industrial safety equipment, such as welding masks, protective masks, safety helmets, etc., and medical safety equipment, such as medical head guards, medical safety helmets, etc., thereby protecting a worker or a wearer from any accident while working.

The headband 100 according to the present invention includes a main band 10 configured to be worn on a wearer's head, adjustment bands 20 connected with both ends of the main band 10 and configured to be adjusted in length according to the size and circumference of the wearer's head, supporting bands 30 extending upward from the main band 10 so as to be put on the top of the wearer's head and support the main band 10, and a length adjustment lever 50 configured to adjust the length of the adjustment bands 20, into which an end of each of the adjustment bands 20 is inserted.

Each of the adjustment bands 20 is formed with a slot, in which saw-teeth are formed. The distal end of each of the adjustment bands 20 is inserted into the left and right sides of the length adjustment lever 50. The length of the adjustment bands 20 is adjusted by rotating a lever 50*a* of the length adjustment lever 50 in a forward or reverse direction.

The adjustment bands 20, which are positioned on both sides of the wearer's forehead, are provided with coupling members, to which a welding mask is coupled. The welding mask is hinged to the coupling members of the adjustment bands 20.

The supporting bands 30 include a first supporting band 31, which is provided in front of the adjustment bands 20 and positioned on the wearer's front head section, and a second supporting band 33, which is provided behind the first supporting band 31 and positioned on the crown of the head.

When the headband 100 of the present invention is put on the wearer's head, the adjustment bands 20 are first placed on the wearer's head, the first supporting band 31 extending from the adjustment bands 20 is positioned on the front head section to support the same, the second supporting band 33 is positioned on the crown of the head to support the same, and the length of the adjustment bands 20 is adjusted using the length adjustment lever 50 so as to be suitable for the circumference and size of the wearer's head.

The cushion bands of the headband 100 of the present invention function to increase the area that supports the wearer's head, thereby providing a comfortable headband-wearing sensation. In addition, the cushion bands function to disperse the weight and load which are concentrated on the wearer's head and to improve air ventilation.

Figure 5:
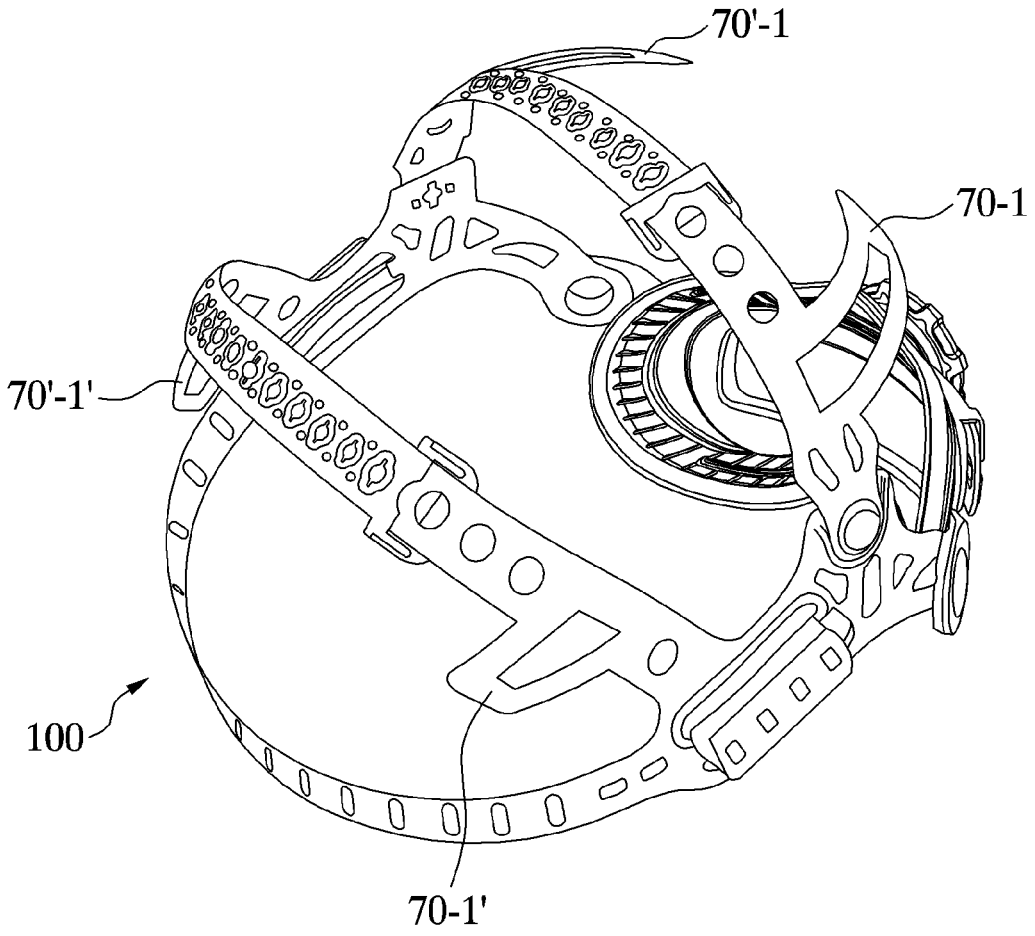
FIG. 5 is a perspective view illustrating a headband according to a second embodiment of the present invention.

The cushion bands may be formed at the two parts of the first supporting band 31, or may be formed at the two parts of the second supporting band 33 as shown in FIGS. 1 through 4, or may be formed at the two parts of each of the first supporting band 31 and the second supporting band 33 as shown in FIG. 5, thereby supporting the wearer's head in a double supporting structure and providing a comfortable headband-wearing sensation.

Further, the cushion bands may be formed to have a wing shape that extends from one side of each part of the supporting bands as shown in FIG. 5, or may be formed to have a wing shape that extends from both sides of each part of the supporting bands as shown in FIGS. 1 through 4, thereby supporting the wearer's head in a double supporting structure and providing a comfortable headband-wearing sensation.

Figure 6:
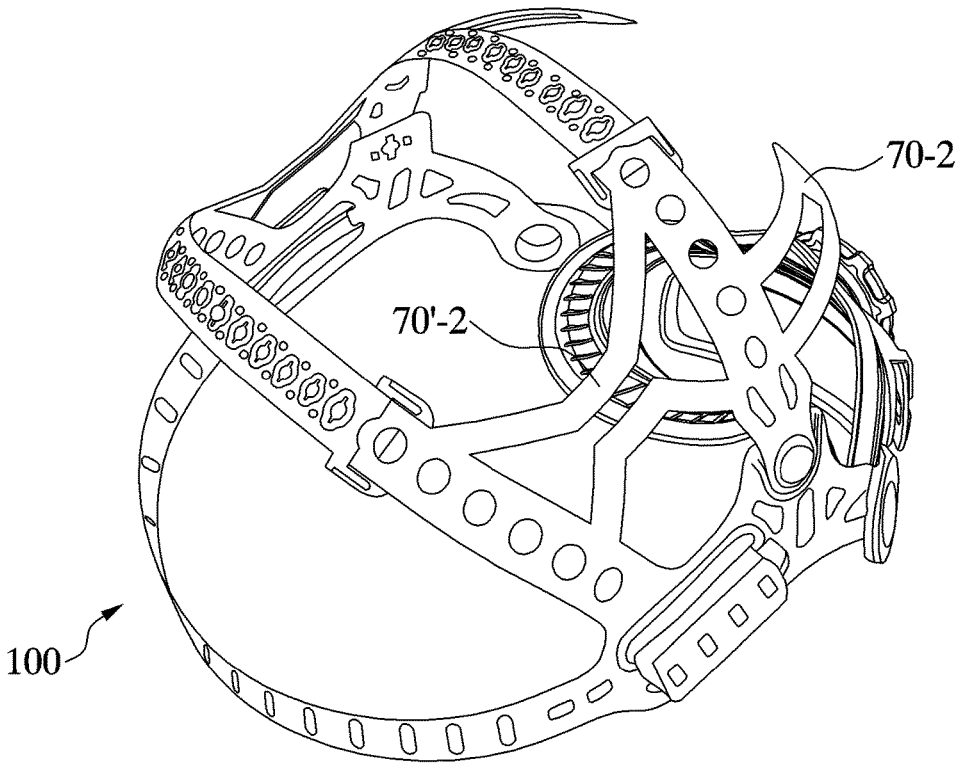
FIG. 6 is a perspective view illustrating a headband according to a third embodiment of the present invention.
Figure 7:
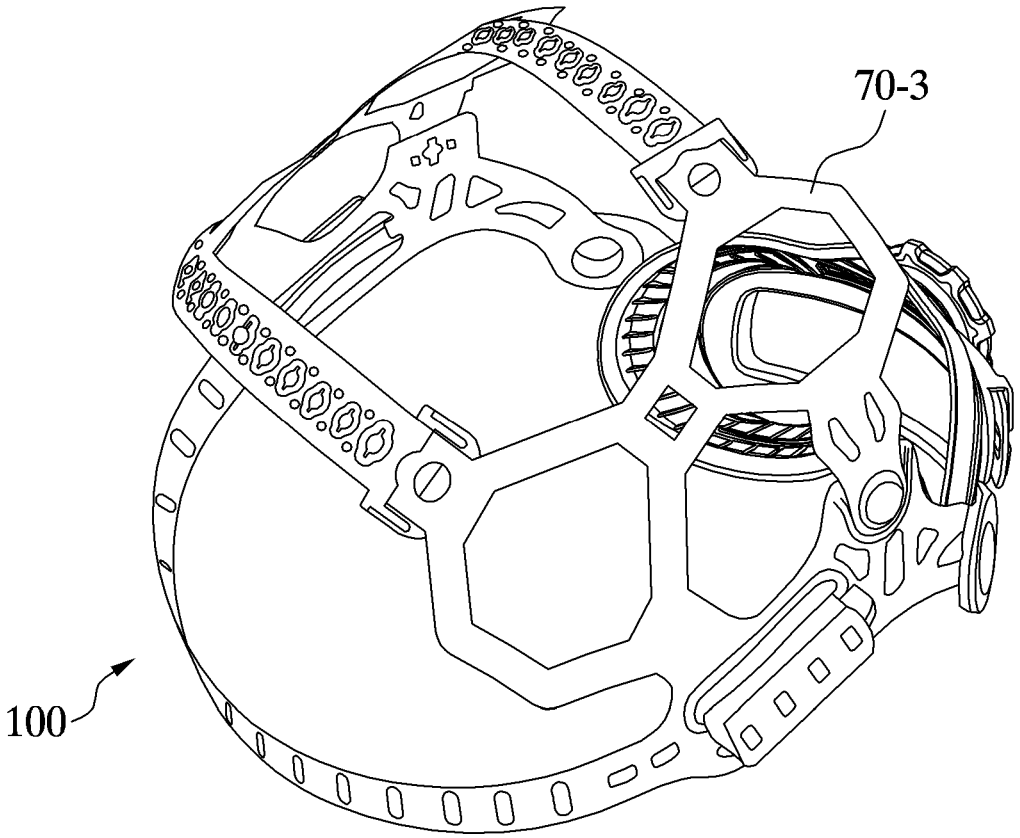
FIG. 7 is a perspective view illustrating a headband according to a fourth embodiment of the present invention.

Further, as shown in FIGS. 6 and 7, the cushion band formed at the first supporting band 31 and the cushion band formed at the second supporting band 33 may be connected to each other, thereby supporting the wearer's head in a double supporting structure and providing a comfortable headband-wearing sensation.

Figure 9:
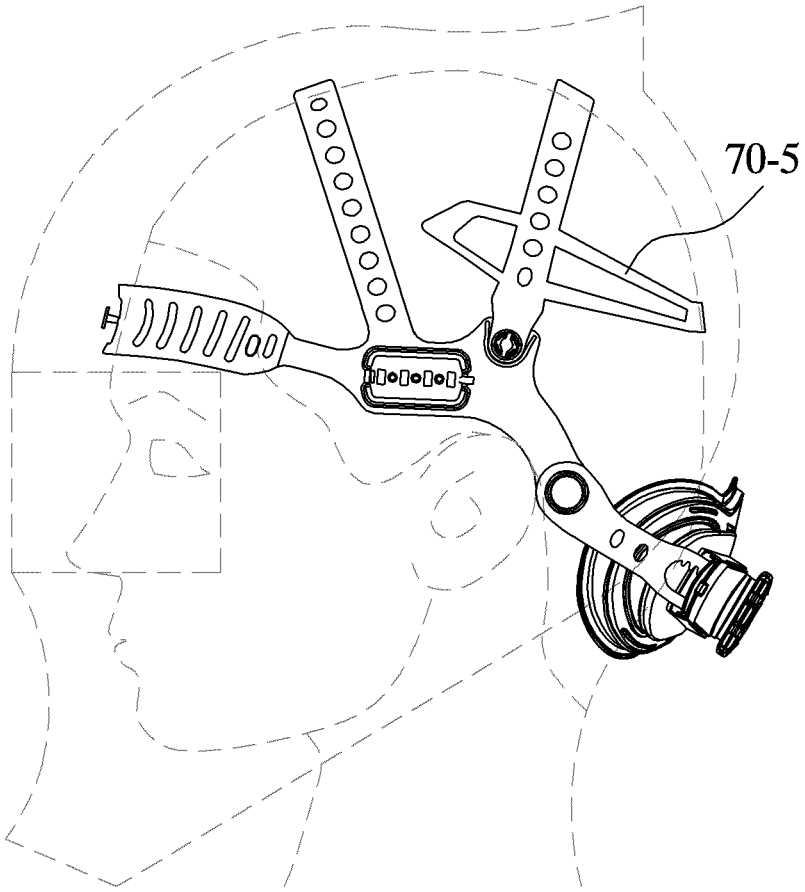
FIG. 9 is a perspective view illustrating the state in which a headband according to a sixth embodiment of the present invention is worn on a wearer's head.
Figure 10:
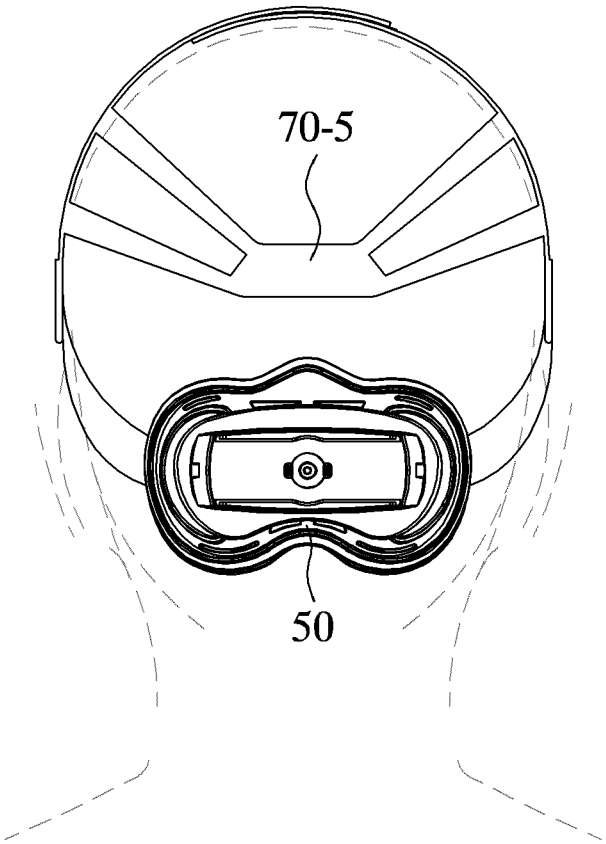
FIG. 10 is a rear view illustrating the state in which the headband depicted in FIG. 9 is worn on a wearer's head.

Further, as shown in FIGS. 9 and 10, the cushion band formed at one part of the second supporting band 33 and the cushion band formed at the other part of the second supporting band 33 are connected to each other, thereby supporting the wearer's head in a double supporting structure and providing a comfortable headband-wearing sensation.

Figure 8:
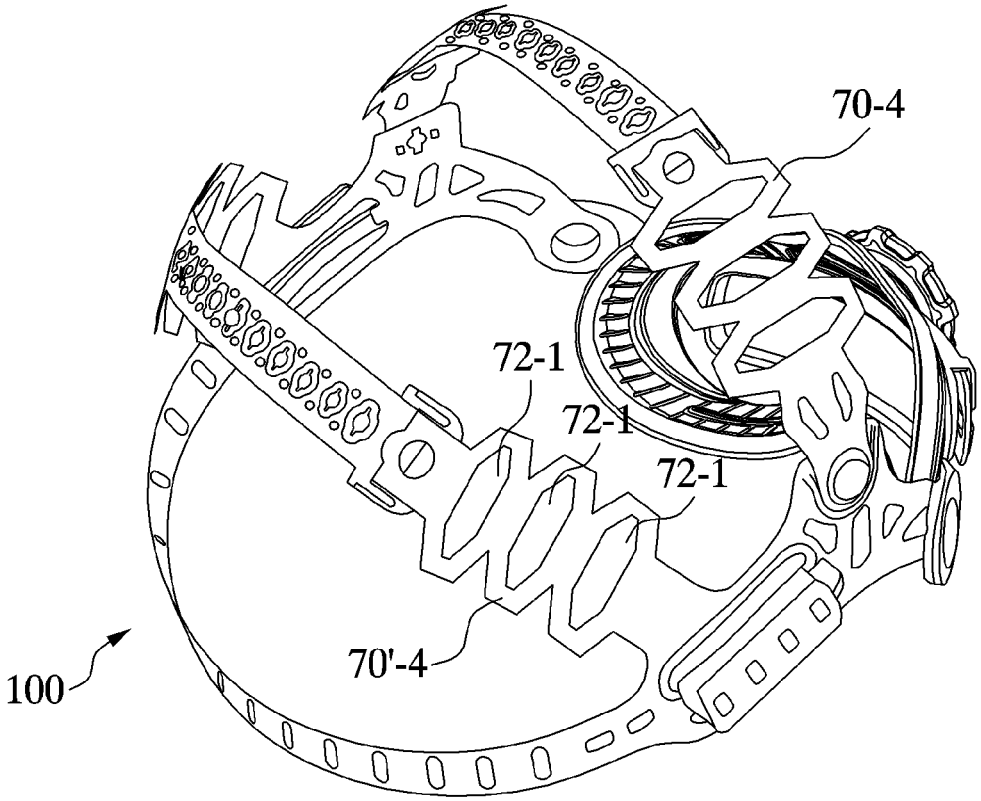
FIG. 8 is a perspective view illustrating a headband according to a fifth embodiment of the present invention.

Each of the cushion bands may be formed with one or more openings 72-1 as shown in FIG. 8, thereby supporting the wearer's head in a double supporting structure and providing a comfortable headband-wearing sensation.

Preferably, the cushion bands 70 and 70' may be made of an elastic material so as to change in shape when external force is applied thereto and return to the original shape thereof when the external force is removed therefrom.

The cushion bands 70 and 70', which come into contact with the wearer's head when he or she puts on the headband 100, are formed with one or more openings 72 and 72'.

The openings 72 and 72', which are formed in the cushion bands 70 and 70', function to increase the region of the cushion bands 70 and 70' that supports the wearer's head while reducing the contact area between the cushion bands and the head. Accordingly, a comfortable wearing sensation is achieved. Further, the weight and load of the welding mask are dispersed, thereby remarkably relieving pressure and pain applied to the central region of the wearer's head, which contacts the cushion bands 70 and 70'.

Furthermore, the openings 72 and 72', which are formed in the cushion bands 70 and 70', function to enable the headband 100 to be easily fitted on the wearer's head and securely maintained in close contact with the head regardless of the shape and size of the wearer's head, and function to avoid contact between the cushion bands 70 and 70' and the central region of the head, which is known to be susceptible to pain, and function to improve air ventilation, thereby preventing the wearer from sweating excessively even when he or she wears the headband 100 for a long time.

Preferably, the cushion bands 70 and 70' may have soft parts, which are made of a soft material and are provided on the bottom surfaces of the cushion bands 70 and 70', which come into contact with the wearer's head. When the wearer wears the headband 100, the soft parts provided on the bottom surfaces of the cushion bands 70 and 70' contact the wearer's head, thereby minimizing the pressure that is applied to the head by the weight and load, and preventing the cushion bands 70 and 70' from being taken off.

Figure 11:
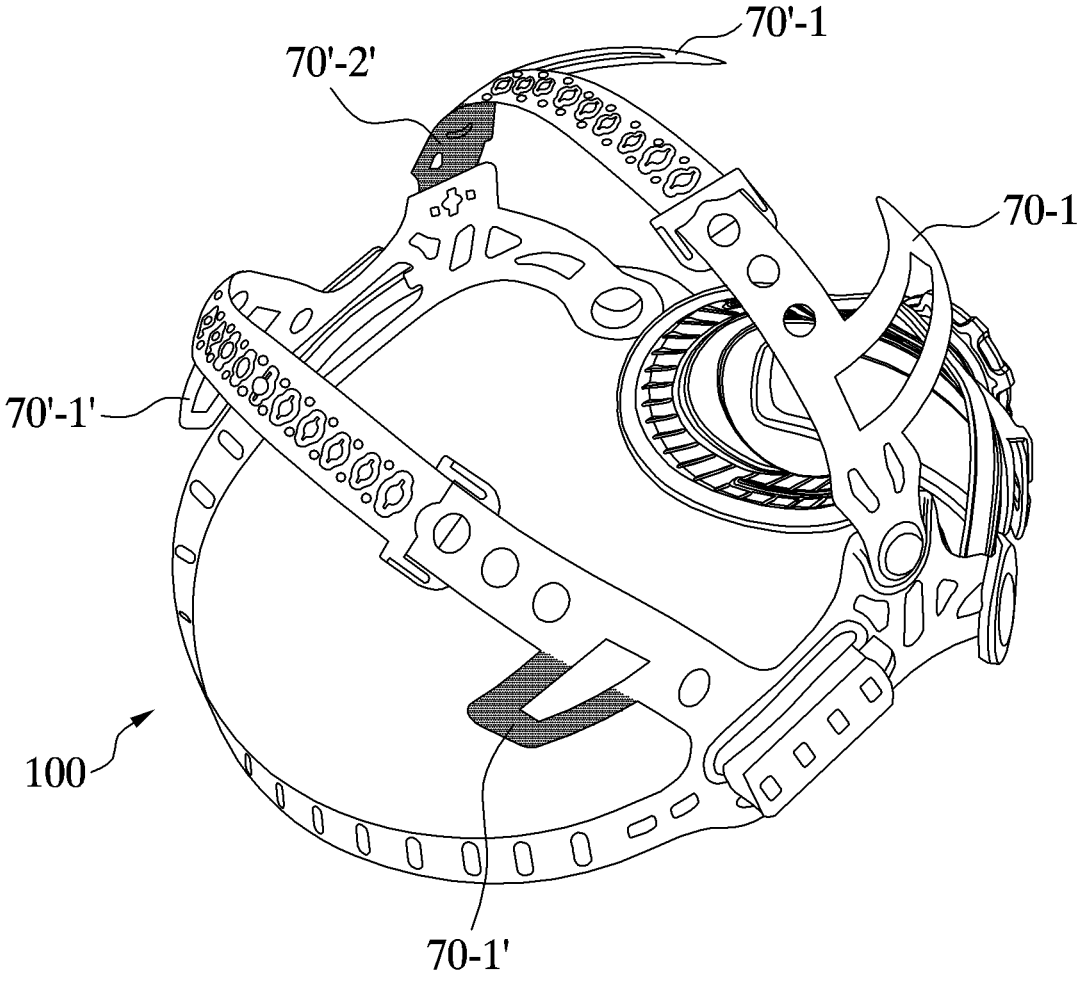
FIG. 11 is a perspective view illustrating a headband according to a seventh embodiment of the present invention.

A functional headband according to the present invention shown in FIG. 11 includes a main band 10 configured to be worn on a wearer's head, supporting bands 30 connected with the main band 10 and configured to be placed on the wearer's head, adjustment bands 20 connected with both ends of the main band 10 and configured to be adjusted in length, and a length adjustment lever 50 configured to adjust the length of the adjustment bands 20. Each of the supporting bands may have a bottom surface 70'-2' that is made of a soft material through a double injection molding process.

The cushion bands 70-1, 70-1', 70'-1 and 70'-1' and the supporting bands may be formed through a double injection molding process so that the cushion bands are made of a soft material.

s is apparent from the above description, the functional headband having an integral cushion band according to the present invention can be easily applied to a conventional headband that is mounted to industrial safety equipment, such as welding masks, protective masks, safety helmets, etc., and medical safety equipment, such as medical head guards, medical safety helmets, etc., thereby achieving an excellent economic effect.

Further, the functional headband having an integral cushion band according to the present invention can increase the region that supports the wearer's head while reducing the contact area with the head, thereby easily supporting the whole region of the head and achieving a comfortable wearing sensation.

Furthermore, the functional headband having an integral cushion band according to the present invention can remarkably relieve pressure and pain and act as a buffer by dispersing the weight and load of the aforementioned safety equipment, and can prevent the wearer from sweating excessively by improving air ventilation.

In addition, since the functional headband having an integral cushion band according to the present invention has flexibility and is thus capable of easily changing in shape and returning to the original shape thereof, it can be easily fitted on the wearer's head and securely maintained in close contact with the head regardless of the shape and size of the wearer's head, and can enhance working efficiency.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A functional headband having an integral cushion band, comprising:

a main band configured to be worn on a wearer's head, wherein the main band is configured to be worn along a forehead and a rear portion of the wearer's head;

a supporting band connected with the main band and configured to be placed on an upper portion of the wearer's head adjacent a temple region of the wearer's head, the supporting band including a first supporting band and a second supporting band spaced apart from the first supporting band, wherein each of the first supporting band and the second supporting band is divided into two parts;

adjustment bands connected with both ends of the main band and to be adjusted in length;

a length adjustment lever to adjust a length of the adjustment bands; and a cushion band integrally extended from at least one of the first supporting band and the second supporting band, wherein the cushion band has a wing shape and is integral with the first supporting band or the second supporting band or both, and the cushion band is bent such that the cushion band is placed on the temple region of the upper portion of the wearer's head when a user wears the functional headband to disperse weight and load concentrated on the wearer's head.

2. The functional headband according to claim 1, wherein the cushion band extends from both sides of the first supporting band.

3. The functional headband according to claim 1, wherein the cushion band extends from one side of each of the first supporting band and the second supporting band.

4. The functional headband according to claim 1, wherein the cushion band formed at the first supporting band and the cushion band formed at the second supporting band are connected to each other.

5. The functional headband according to claim 1, wherein the cushion band is formed with one or more openings.

6. The functional headband according to claim 1, wherein the supporting band has a bottom surface made of a soft material.

7. The functional headband according to claim 1, wherein the cushion band is made of a soft material.

8. The functional headband according to claim 1, further comprising a cushion member attached to an inner surface of the length adjustment lever.

9. The functional headband according to claim 1, wherein the cushion member is centrally concave from upper and lower and left and right sides thereof so as to come into close contact with the rear portion of the wearer's head.

* * * * *